United States Patent [19]

Faulkner et al.

[11] 4,306,171

[45] Dec. 15, 1981

[54] FOCUSING STRUCTURE FOR PHOTOMULTIPLIER TUBES

[75] Inventors: Richard D. Faulkner; Robert E. McHose, both of Lancaster, Pa.

[73] Assignee: RCA Corporation, New York, N.Y.

[21] Appl. No.: 65,842

[22] Filed: Aug. 13, 1979

[51] Int. Cl.[3] ..... H01J 40/04

[52] U.S. Cl. ..... 313/95

[58] Field of Search ..... 313/95

[56] References Cited

U.S. PATENT DOCUMENTS

| | | | |
|---|---|---|---|
| 2,676,282 | 4/1954 | Polkosky | 313/102 |
| 3,771,004 | 11/1973 | Plumeau | 313/95 |
| 3,872,337 | 3/1975 | Davis et al. | 313/95 |
| 3,875,441 | 4/1975 | Faulkner | 313/95 X |
| 4,006,376 | 2/1977 | Faulkner et al. | 313/95 |
| 4,060,747 | 11/1977 | Faulkner | 313/95 |
| 4,079,282 | 3/1978 | Faulkner et al. | 313/95 |
| 4,112,325 | 9/1978 | Faulkner | 313/95 |
| 4,112,326 | 9/1978 | Faulkner | 313/95 |
| 4,125,793 | 11/1978 | Timan | 313/95 |

*Primary Examiner*—Palmer C. Demeo

*Attorney, Agent, or Firm*—Eugene M. Whitacre; Dennis H. Irlbeck; Vincent J. Coughlin, Jr.

[57] ABSTRACT

An electron discharge tube includes an evacuated envelope comprising a photocathode, an anode, a primary dynode and a secondary dynode for propagating and concatenating electron emission from the photocathode to the anode. A focusing electrode is disposed between the photocathode and the dynodes. The focusing electrode is capable of generating an electric field for focusing the electron emission between the photocathode and the primary dynode and also between the primary dynode and the secondary dynode. The focusing electrode has a planar surface that is reflective to light transmitted through the photocathode so that some of the transmitted light is returned to the photocathode to increase the responsivity of the tube.

6 Claims, 4 Drawing Figures

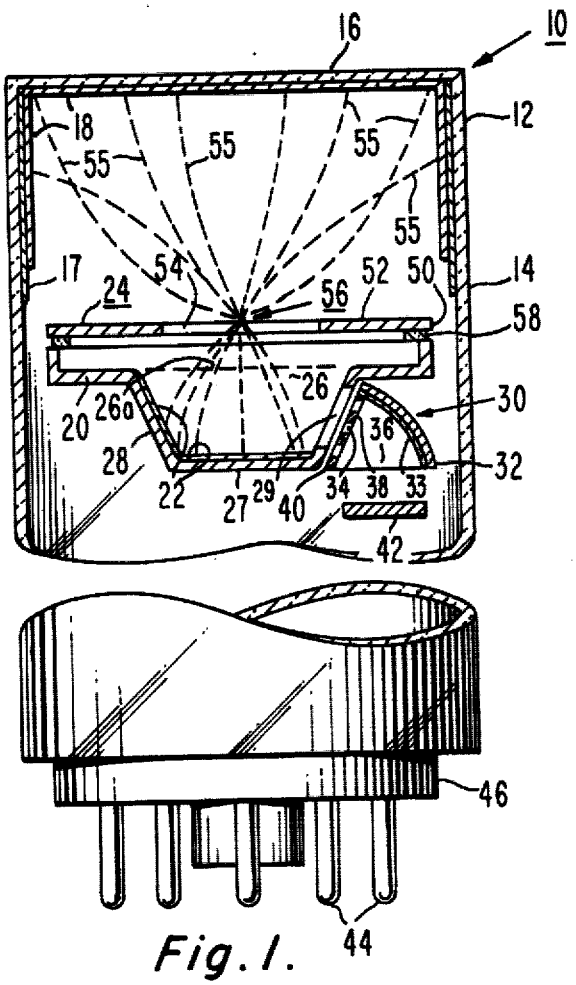
Fig. 1.
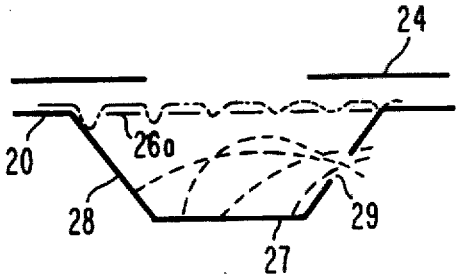
Fig. 2.
Fig. 4.
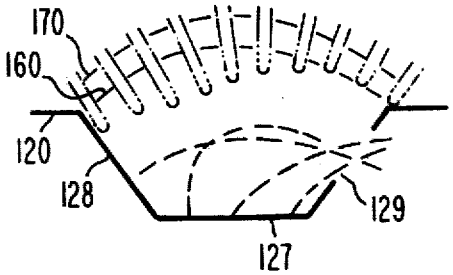

FOCUSING STRUCTURE FOR PHOTOMULTIPLIER TUBES

BACKGROUND OF THE INVENTION

The present invention relates to photomultiplier tubes and particularly to an improved focusing structure which alters the electron-optical field in the vicinity of the secondary emitting surface of the primary dynode.

Electron emissive electrodes are used in photomultiplier tubes to emit an electron in response to each impinging photon or a plurality of secondary electrons for each impinging primary electron. The primary electrons can be photoelectrons from a photocathode or secondary electrons from another dynode. The problem that has been encountered in the construction of phototubes has been to efficiently collect electrons emitted from one stage of an electron multiplier by another stage. In particular, the problem has been to maximize the collection of electrons at the input stage of the electron multiplier, i.e., photoelectrons from a photocathode to the first dynode of an electron multiplier. An increase in the efficiency of collection of electrons at the input stage increases the signal-to-noise ratio.

A first dynode having a large collection area is disclosed in U.S. Pat. No. 4,112,325 to R. D. Faulkner, issued Sept. 5, 1978. The dynode is generally teacup shaped having a substantially circular top opening facing the photocathode and a flat base. A generally curved side wall connects the base to a circular rim around the periphery of the top opening. The side wall includes a flat region having an aperture through which secondary electrons exit the dynode. The region of the dynode opposite the exit aperture including a portion of the lower sidewall is generally referred to as the "heel" region. In the operation of the teacup dynode, it has been determined that secondary electrons emitted from the "heel" region of the dynode are not effectively focused onto the secondary emissive areas of the second dynode because the strong negative electrostatic field from the photocathode suppresses the emission of secondary electrons from the "heel" region of the dynode and causes those secondary electrons which are emitted from the "heel" to be returned to the teacup dynode.

In many applications such as scintillation counting, for example, it is required that the output of a photomultiplier be linear with light input. Since the light energy of scintillations is directly proportioned to the gamma-ray energy over a certain range, an electrical pulse obtained from a photomultiplier tube is a direct measure of the gamma-ray energy. Consequently, an important requirement of photomultipliers used in scintillation counting is the ability to discriminate between pulses of various height. The parameter indicating the ability of a tube to perform this discrimination is called pulse-height resolution. The pulse-height resolution of photomultiplier tubes having a preliminary teacup dynode may be improved by effectively utilizing all the secondary electrons emitted by the active area of the first dynode and focusing these secondary electrons onto the active area of the second dynode. The active areas or surfaces comprise a surface region of the dynodes from which secondary electrons may be generated, and from which the secondary electrons may then be properly accelerated as an electron stream to subsequent elements, in ordered sequence, for ultimate collection by the anode.

SUMMARY OF THE INVENTION

An electron discharge tube includes a photocathode, a primary dynode and a secondary dynode. A focusing means is provided for focusing the electron emission between the photocathode and the primary dynode and also between the primary dynode and the secondary dynode.

BRIEF DESCRIPTION OF THE DRAWINGS

FIG. 1 is a partial cross-sectional view of the present novel photomultiplier tube.

FIG. 2 is a schematic view of a focus electrode and a dynode with a typical resultant electrostatic field lines of the present tube shown in FIG. 1.

FIG. 4 is a schematic view of a focus electrode and a dynode with a typical resultant electrostatic field lines of the embodiment shown in FIG. 3.

DESCRIPTION OF THE PREFERRED EMBODIMENT

Figure 3:
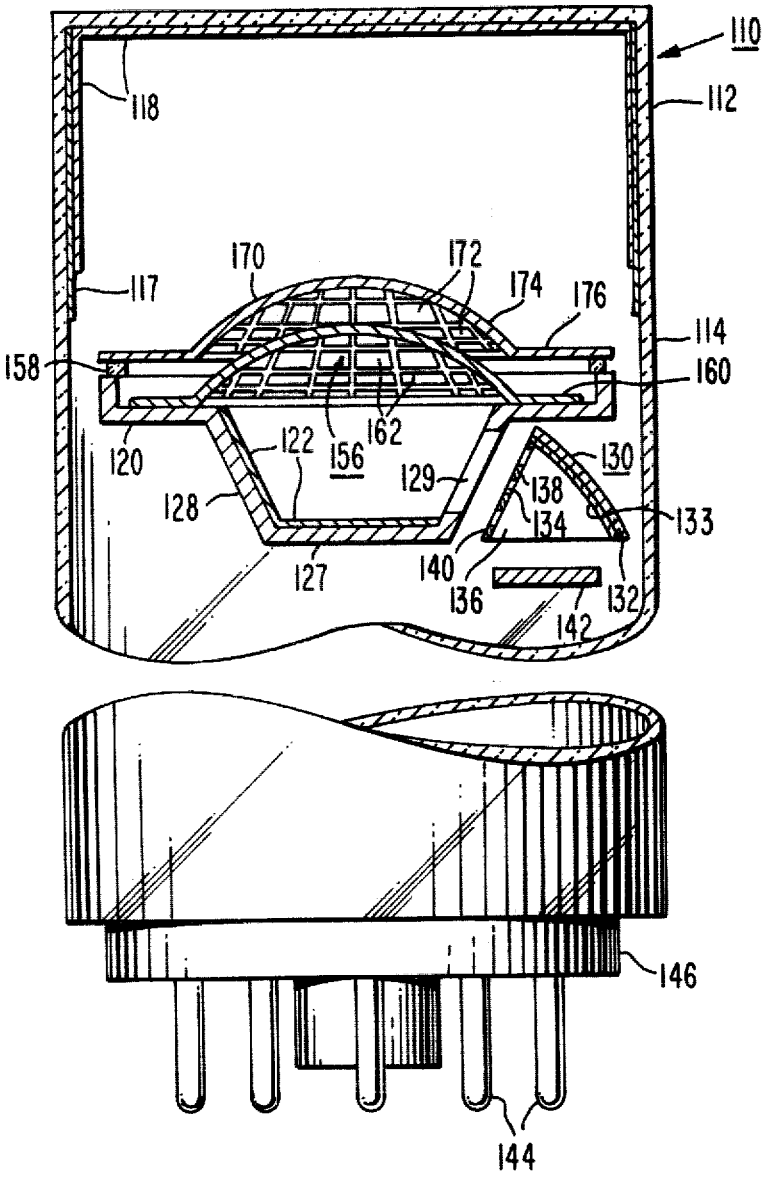
FIG. 3 is a partial cross-sectional view of another embodiment of the present novel photomultiplier tube.

Referring to FIG. 1, there is shown a photomultiplier tube 10 comprising an envelope 12 having a cylindrical sidewall 14 and a circular faceplate 16. An aluminized coating 17 is disposed on a portion of the sidewall 14 adjacent to the faceplate 16. Within the tube 10 is a photocathode 18 on the faceplate 16 and also along a portion of the aluminized coating 17 on the sidewall 14. The portion of the photocathode 18 on the faceplate 16 is transparent while the portion of the photocathode 18 along the aluminized coating 17 is of a reflective type. The photocathode 18 may be cesium antimonide, for example, or any one of a number of photoemissive materials well known in the art.

Inside the tube 10 is a primary or first teacup dynode 20 having a secondary emissive coating 22 adjacent to a surface thereof which faces the faceplate 16. An apertured focusing electrode 24 is disposed in spaced relation between the dynode 20 and the (transparent portion of) photocathode 18 (on the faceplate 16). The teacup dynode has a substantially circular top opening or input aperture 26 covered by a planar mesh **26*a*, a substantially flat base 27, and a generally curved sidewall 28 which connects the base to the periphery of the top opening 26. An output aperture 29 extends through a flat region of the sidewall 28**.

A box-like second dynode 30 having a curved surface 32 with a secondary emission coating 33 thereon and having two parallel surfaces (not shown) perpendicular to said curved surface 32 acts as a receiving member for secondary electrons emitted from the teacup dynode 20. The dynode 30 has an input aperture 34 and an output aperture 36. The input aperture 34 is covered by a planar mesh 38 and a portion 40 of the periphery of the output aperture 36 is formed by the mesh 38. Secondary electrons from the second dynode 30, passing through output aperture 36, serve as primary electrons impinging upon an anode 42. While only two dynodes are shown in FIG. 1 for propagating and concatenating electron emission from the photocathode 18 to the anode 42, it is clear to one skilled in the art that a plurality of additional secondary dynodes may be included between the second dynode 30 and the anode 42. The total number of dynodes is governed among other things, by the final gain desired from the tube. The teacup dynode 20 and the box-like dynode 30 are described in detail in U.S. Pat. No. 4,112,325, referenced above and incorporated by reference herein.

Each of the dynodes 20 and 30, the focusing electrode 24, the photocathode 18 and the anode 42 has a conductive wire attached thereto for placing an electrostatic charge thereon. The wires (not shown) terminate at the metal pins 44 located at the base 46 of the tube 10.

The novel focusing electrode 24 comprises a substantially flat apertured disc-shaped member 50 having a highly reflective planar major surface 52 facing and substantially parallel to the photocathode 18 on faceplate 16. The disc-shaped member 50 includes a central aperture 54, permeable to electrons, having a diameter substantially equal to the length of the flat base 27 of dynode 20. The electron lens system of tube 10 including electrode 24 is designed to improve the focus of a primary electron stream 55 of the emitted photoelectrons from photocathode 18 into a single electron bundle, and to confine impingement subsequently upon the active region of surface 27 and substantially all of surface 28 of dynode 20. To this end, the focusing electrode 24 is coaxially mounted within the envelope 12 substantially at a crossover region 56 of the electron stream 55 emitted from the photocathode. The electrode 24 is electrically isolated from dynode 20 by ceramic spacers 58 interposed between the facing surfaces of dynode 20 and electrode 24.

An increase in responsivity of the photomultiplier tube can be obtained by reflecting back to the photocathode 18 a portion of the incident light which was initially unabsorbed by the transparent portion of the photocathode. Responsivity is defined as the ratio of the output current or voltage of a photodetector to the input flux in watts or lumens (RCA Electro-Optics Handbook, 1974). By making the planar surface 52 of the focusing electrode 24 highly reflective, a portion of the light transmitted through the transparent portion of the photocathode 18 will be returned to the photocathode, resulting in the emission of additional photoelectrons.

In order to generate a useful anode output signal current from the operative tube, the teacup dynode 20 is at an electrostatic potential which is positive, i.e., less negative, with respect to the photocathode 18. This is accomplished in the usual manner with a voltage divider and a power supply connected to the voltage divider (not shown). Each successive dynode and the anode is more positive than the preceding dynode. To confine the photoelectrons emitted from the photocathode 18 to the active area including surfaces 27 and 28 of the first dynode 20 which emits its secondary electrons most efficiently to the second dynode, and to focus the emitted secondary electrons onto the active area 32 of the dynode 30, Applicants have found that the potential applied to the focusing electrode 24 may be varied between photocathode potential and first dynode potential. The optimum operating potential is slightly more negative than the potential applied to the first dynode 20. The optimum operating potential reduces the size of the "heel" region of the teacup dynode 20 and thereby maximizes the efficient active area of the surfaces 27 and 28 of the dynode 20.

The theory of operation of the novel focusing electrode 24 and its advantages can be seen by referring to FIG. 2. In FIG. 2, a schematic view of an annular focusing electrode 24 and a teacup dynode is shown. For clarity, the paths of the primary electrons, emitted from the photocathode are not shown, but they are confined by electrode 24 to impinge on the active area of dynode 20. The dotted lines represent trajectories of secondary electrons released by the teacup dynode 20 as they exit via the output aperture 29. As it was previously discussed, the two functions of the novel focusing electrode 24 are to maximize the number of primary electrons impinging on the active area including surfaces 27 and 28 of the teacup dynode 20 and to assist in focusing the secondary electrons exiting from the dynode 20 onto the active area 32 of the secondary dynode 30. The positive potential on the secondary dynode 30 provides a field which attracts the secondary electrons from dynode 20. Both functions described above have been performed by locating the electrode 24 approximately at the electron crossover region 56 and applying a suitable potential to the electrode. The electric field within the teacup dynode 20 resulting from the potentials on the photocathode 18, the focusing electrode 24 and the teacup dynode 20, including the planar mesh 26*a*, is shown as a dash-dot-dash line. Since this field is negative compared to the dynode, the secondary electrons are inhibited by this field and are constrained to exit the dynode through aperture 29.

In FIG. 3, there is shown another embodiment of a photomultiplier tube, generally designated as 110, having a domed dynode mesh 160 such as that described in U.S. Pat. No. 4,060,747 to R. D. Faulkner, issued Nov. 29, 1977 and incorporated by reference herein. The domed dynode mesh 160 has openings 162 of non-uniform size. The photomultiplier tube 110 further includes a novel focusing mesh 170 having a plurality of openings 172 of non-uniform size and a peripheral portion 174. The focusing mesh 170 is substantially identical in structure to the dynode mesh 160 with the exception that an annular ring 176 which is attached for support purposes around the peripheral portion 174 of focusing mesh 170 is highly reflective to light transmitted through the transparent photocathode 118. The reflective portion of ring 176 serves the same function as planar surface 52 of focusing electrode 24 discussed above. The focusing mesh 170 is coaxially mounted within the envelope 112, substantially at a crossover region 156 of the electron stream (not shown) emitted from the photocathode 118. The focusing mesh 170 is electrically isolated from the teacup dynode 120 and the dynode mesh 160 by ceramic spacers 158 interposed between the facing surfaces of the focusing mesh 170 and the dynode 120. The remaining structural elements of photomultiplier tube 110 are identical to the similarly enumerated elements of tube 10 shown in FIG. 1, except that the first digit of each number is increased to identify the embodiment.

In operation and function, the focusing mesh 170 is substantially identical to the focusing electrode 24 described above. In FIG. 4, a schematic view of the focusing mesh 170 and the domed dynode mesh 160 on the teacup dynode 120 is shown. For clarity, the paths of the primary electrons emitted from the photocathode 118 are not shown, but they are confined by the focusing mesh 170 and the dynode mesh 160 to impinge on the active area including surface 127 and substantially all of surface 128 of dynode 120. The dotted lines represent trajectories of secondary electrons released by the teacup dynode 120 as they exit via the output aperture 129. By applying a suitable potential to the focusing mesh 170, e.g., a potential that is slightly more negative than the potential applied to the teacup dynode 120, the secondary electrons are focused and constrained to exit the dynode 120 through aperture 129 so as to impinge on the active area 132 of the subsequent dynode 130. The electric field within the teacup dynode 120 resulting from the potentials on the photocathode 118, the focusing mesh 170, the dynode mesh 160, and the dynode 120 is shown as a dash-dot-dash line.

While the focusing mesh 170 is shown in FIG. 3 to be a domed mesh having opening 172 of non-uniform size, it is clear that other suitable mesh configurations, such as a flat mesh having openings of uniform size, may be used. Thus, Applicants' invention is not limited to the structure herein described but includes all equivalent structures, wherein the focusing electrode is located at the crossover region of the primary electron emission from the photocathode and the focusing electrode is operated at a potential between cathode potential and first dynode potential but preferably at a potential more negative than the potential applied to the first dynode.

We claim:

1. In an electron discharge tube comprising an evacuated envelope having therein, an electron emissive photocathode, a primary dynode having a substantially circular top opening for receiving electrons from said photocathode and an active area upon which substantially all of said electrons from said photocathodes impinge, thereby emitting secondary electrons therefrom, and a secondary dynode adjacent to said primary dynode for receiving said secondary electrons, the improvement comprising the combination of:

an electrically conductive mesh adjacent to said primary dynode and covering said top opening of said primary dynode, and focusing means spaced from said mesh, said means being disposed between and electrically isolated from said photocathode and said dynodes for focusing electron emission between said photocathode and said active area of said primary dynode, and in conjunction with said photocathode, said primary dynode and said mesh, for focusing said secondary electrons between said primary dynode and said secondary dynode.

2. The tube as in claim 1 further comprising an anode in communication with said secondary dynode and spaced therefrom, and wherein said mesh adjacent to said primary dynode being substantially planar, said primary dynode comprising a teacup dynode and said secondary dynode comprising a box-shaped dynode.

3. The tube as in claim 1 wherein said focusing means comprises an apertured electrode coaxially mounted within said envelope substantially at a crossover region of said electron emission, said apertured electrode having a planar major surface facing and substantially parallel to said photocathode.

4. The tube as in claim 3 wherein the planar major surface of said apertured electrode is reflective to light transmitted through said photocathode so that some of the transmitted light incident on said reflective surface is returned to said photocathode thereby increasing the responsivity of the tube.

5. In an electron discharge tube comprising an evacuated envelope, an electron emissive photocathode, a teacup dynode having a substantially circular top opening for receiving electrons from said photocathode and an active area upon which substantially all of said electrons from said photocathode impinge, thereby emitting secondary electrons therefrom, a secondary dynode for receiving said secondary electrons, and an anode spaced from said secondary dynode, the improvement comprising the combination of:

a dome-shaped radially symmetric dynode mesh covering said top opening of said teacup dynode, the apex of said dynode mesh being closer to said photocathode than is the peripheral portion of said dynode mesh, and focusing means spaced from said dynode mesh, said focusing means being disposed between said photocathode and said dynode for focusing electron emission between said photocathode and said active area of said teacup dynode, and in conjunction with said photocathode, said teacup dynode and said dynode mesh, for focusing said secondary electrons between said teacup dynode and said secondary dynode.

6. The tube as in claim 5 wherein said focusing means includes a focusing mesh spaced between and electrically isolated from said photocathode and said dome-shaped mesh, said focusing mesh being located substantially at a crossover region of said electron emission, said focusing mesh having an annular ring attached thereto, said annular ring having a reflective, planar major surface facing and substantially parallel to said photocathode for returning to said photocathode some of the light transmitted through said photocathode and incident on said reflective surface of said annular ring, thereby increasing the responsivity of said tube.

* * * * *